US010668994B2

(12) United States Patent
Frank

(10) Patent No.: US 10,668,994 B2
(45) Date of Patent: Jun. 2, 2020

(54) MAST AND CORRESPONDING RIG, IN PARTICULAR FOR A SURFBOARD

(71) Applicant: ROBERT FRANK GMBH & CO. KG, Berchtesgaden (DE)

(72) Inventor: Robert Frank, Berchtesgaden (DE)

(73) Assignee: ROBERT FRANK GMBH & CO. KG, Berchtesgaden (DE)

( * ) Notice: Subject to any disclaimer, the term of this patent is extended or adjusted under 35 U.S.C. 154(b) by 8 days.

(21) Appl. No.: 16/068,766

(22) PCT Filed: Dec. 20, 2016

(86) PCT No.: PCT/EP2016/081907
§ 371 (c)(1),
(2) Date: Jul. 9, 2018

(87) PCT Pub. No.: WO2017/125232
PCT Pub. Date: Jul. 27, 2017

(65) Prior Publication Data

US 2019/0023360 A1 Jan. 24, 2019

(30) Foreign Application Priority Data

Jan. 19, 2016 (DE) ..... 10 2016 000 499

(51) Int. Cl.
*B63B 35/79* (2006.01)

(52) U.S. Cl.
CPC ..... *B63B 35/7976* (2013.01); *B63B 35/7953* (2013.01); *B63B 35/7969* (2013.01); *B63B 2035/7956* (2013.01)

(58) Field of Classification Search
CPC ..... B63B 35/7976; B63B 35/7953; B63B 2035/7956; B63B 35/7969
(Continued)

(56) References Cited

U.S. PATENT DOCUMENTS 4,501,214 A * 2/1985 Meyer ..... B63B 35/7959 114/39.12
4,593,638 A 6/1986 Cochran et al.
2002/0166488 A1* 11/2002 Montilla De Mora ..... B63B 35/7916 114/39.12

FOREIGN PATENT DOCUMENTS

DE 84 01 722 7/1984
DE 84 09 888 11/1984
(Continued)

OTHER PUBLICATIONS

International Preliminary Report on Patentability dated Jul. 24, 2018 issued in PCT/EP2016/081907 (6 pages).
(Continued)

*Primary Examiner* — Anthony D Wiest
(74) *Attorney, Agent, or Firm* — Nixon & Vanderhye P.C.

(57) ABSTRACT

A mast for a rig for a surfboard is characterized among others by the following features: a mast with a profiled cross-section in the longitudinal direction, said cross-section being formed transversely to the mast longitudinal direction and deviating from a circular shape; the profiled cross-section has the shape of a droplet or has a droplet-like design in the manner of a droplet profile; the mast has a fork tree head securing section which can be rotated or pivoted about the fork tree head securing section; the fork tree head securing section is provided with a cross-section which deviates from the droplet profile; and the mast lower part and the mast upper part of the mast consist of plastic or comprise plastic optionally with the addition of a reinforcement consisting of metal, glass fibers, and/or carbon fibers.

30 Claims, 7 Drawing Sheets

(58) Field of Classification Search
USPC ..... 114/39.12, 39.16
See application file for complete search history.

(56) References Cited

FOREIGN PATENT DOCUMENTS

| | | | | | |
|---|---|---|---|---|---|
| DE | 84 07 643 | | | 3/1985 | |
| DE | 85 01 047 | | | 5/1985 | |
| DE | 86 06 514 | | | 7/1986 | |
| EP | 30495 | A | * | 6/1981 | ..... B63B 35/7973 |
| EP | 0 155 012 | | | 9/1985 | |
| FR | 2 470 725 | | | 6/1981 | |
| WO | WO8701089 | A | * | 2/1987 | ..... B63B 35/7969 |

OTHER PUBLICATIONS

International Search Report for PCT/EP2016/081907, dated Apr. 19, 2017, 4 pages.

* cited by examiner

MAST AND CORRESPONDING RIG, IN PARTICULAR FOR A SURFBOARD

This application is the U.S. national phase of International Application No. PCT/EP2016/081907 filed 20 Dec. 2016, which designated the U.S. and claims priority to DE Patent Application No. 10 2016 000 499.1 filed 19 Jan. 2016, the entire contents of each of which are hereby incorporated by reference.

The invention relates to a mast according to the preamble of claim 1 and to a corresponding rig, in particular for a surfboard.

Windsurfing continues to enjoy widespread popularity.

What is decisive, in addition to the design of the actual surfboard, is in particular the design of the rig, i.e. the configuration of the corresponding mast, the sail held thereby and the boom. What is also decisive is the fastening of the boom to the mast, and the manner in which the sail surrounded by the boom can be trimmed at the mast end.

In rigs of this kind, it is important for the sail to have a sail surface area that is as large as possible. Said surface area can in principle be increased upwards or in width. In the case of an upward increase, however, the force required to hold the sail (by means of the boom) also increases, in particular when there is strong wind. In addition, the angle of attack changes on account of the height of the sail, meaning that the wind flow breaks down variably and the efficiency is reduced as a result.

For this reason, it is known to broaden the sail in order to increase the sail surface area. This involves the mast being tensioned in an arcuate manner when the sail is unfurled, such that the sail is under tension in the vertical direction. This means, however, that the trimming possibility, i.e. the adjustment of the sail tension to different wind speeds, is limited. In addition, a large number of sail battens are usually required in order to avoid the sail flapping.

Finally, current rig designs are also comparatively heavy, which makes starting in the water difficult in particular.

A generic rig is known from DE 84 01 722 U1. This document discloses a mast comprising a mast core and a mast cover, the mast cover being made of a lightweight resilient foam which is provided with a water-tight coating on the outside that has a high degree of tear strength.

The mast core itself has a circular cross section; however, the mast cover thereof results in a cross-sectional shape that differs therefrom, specifically having a profile cross section that is drop-shaped. A groove for receiving a luff of a sail is provided at the tapering end of the drop profile. In this case, the mast is divided into three parts in the longitudinal direction: a central portion used to fasten a boom head, and one portion positioned thereabove and one therebelow.

U.S. Pat. No. 4,593,638 also discloses a rig including a mast that is round in cross section and is surrounded by an inner bush that is open towards the bottom in order to receive and hold a sail.

DE 85 01 047 U1 also discloses a process of anchoring a sail to a mast that is fundamentally comparable to or carried out in the same technical manner as the anchoring in the above-mentioned prior publications. A corresponding rig involving a comparatively more complex fastening of the boom head to a mast is known from DE 84 07 643 U1, for example. The mast in this case is usually, as in most cases, a circular mast tube.

DE 84 09 888 U1 also discloses a rig that is similar in this respect and comprises a mast that is circular in cross section. In this case, too, the sail is raised on the mast by means of a mast sleeve. The mast in this case is permanently bent, the bending being intended to be more pronounced at the top end of the mast than at the bottom end of the mast. The boom itself is rotationally fixed to the mast by means of the boom head thereof. The space between the mast and the inside of the mast sleeve is lined with a buoyant insert, preferably made of flexible foam. This is intended to improve the buoyancy of the mast.

The wide range of mast designs are also known from EP 0 155 012 A1. For example, FIG. 1 of this publication schematically shows a cylindrical mast in cross section. FIG. 2 shows a profiled mast in drop-shaped cross section. A T-shaped or T-like groove is made in the tapering end of this drop profile, by means of which a sail can be inserted and held by means of a bead formed on the sail. Both of these cases involve a mast that runs straight and is inherently non-arcuate.

The above-mentioned and pre-published EP 0 155 012 A1 proposes, by way of derogation from a previously known round mast cross section or a previously known profiled mast cross section that differs from the circular shape, a design that is much more complex by comparison, and in which a round mast is taken as a basis, with the entire region in front of and behind the mast being clad by a complex structure. This structure, which is used as cladding and surrounds the round mast, simulates a sail sleeve in which the battens for reinforcing the sail can also terminate.

It can be concluded that the masts proposed according to the prior art are primarily straight and have a circular cross section. As a result, the mast bend required for a sail profile can be achieved only with very significant effort using trim blocks. This also results in the material of the sail having to be considerably more stable and reinforced at numerous points. Consequently, however, the sail as a whole becomes heavier, more rigid and more expensive. What's more, there is a weak profile in particular when there is little wind, meaning less propulsion as a result. In addition, the sail battens which are also usually used to improve propulsion are difficult and expensive to trim.

In light of this, the object of the present invention is to provide an improved rig and/or improved parts of a rig, such as an improved mast, as a result of which, inter alia, preferably undesirable turbulence which reduces the propulsion speed can be avoided.

This object is achieved according to the invention by features relating to a mast according to claim 1 and relating to a rig, including the mast, according to claim 16. Advantageous embodiments of the invention are provided in the dependent claims.

The invention proceeds from a mast having a profile that differs from a circular shape at least over the substantial longitudinal extension thereof.

Specifically, the mast according to the invention is provided with a drop-shaped or drop-like cross-sectional profile, with a groove being made in the tapering end of the drop profile. The sail comprising a corresponding anchoring portion can be inserted in and held by said groove, which is provided with undercuts. For this purpose, the sail can have a corresponding thickened portion which engages in the undercut in the groove, or a corresponding engagement and holding element. This embodiment is therefore such that a usual mast sleeve on the sail, by means of which a conventional sail is raised on a mast, is no longer provided. In particular, said mast sleeve cannot fill up with water either, meaning that a water-start is made considerably easier since the weights to be lifted when raising the sail and thus the rig are lower overall.

Finally, the drop-shaped profiling of the mast results in the cross-sectional shape that is desired per se, by means of which the wind can optimally sweep over the sail surface area without resulting in turbulence that impairs handling or reduces the propulsion forces, or any other relevant turbulence.

In a fastening portion for a boom head (i.e. a boom front arch), the mast according to the invention is provided, over a comparatively small partial length, with profiling that differs from the drop-shaped profiling. Said profile is designed such that a boom head can be fastened at this point. The mast fastening is designed such that the boom can be rotated freely relative to the mast in this region, and thus can be pivoted from left to right about the mast axis in the region of said fastening portion. For this purpose, the mast according to the invention preferably has a circular profile in cross section. This markedly improves overall handling compared with hitherto known solutions. For example, by way of derogation from DE 84 09 888 U1, a connection between the boom and the mast for conjoint rotation is thus deliberately omitted and/or a rigid connection of this kind is deliberately avoided.

The mast is preferably made from plastics material. In particular, a variant is preferred in which the mast consists of carbon fibre reinforced plastics material or includes or substantially includes carbon fibre reinforced plastics material. In addition, in a preferred variant of the invention, the mast is inherently designed not as a rod that runs straight and is profiled in cross section, but is inherently designed so as to be bent in the shape of a crescent or like a whip. As a result, the trimming forces ultimately required for the sail can be considerably reduced, all the while having a large sail surface area that is achievable and desirable when the mast has a corresponding arcuate shape.

Finally, in a development of the invention, the boom head is attached to the straight portion of the mast by means of a hollow-cylindrical connection element. The preferred rotational movement of the boom as a whole relative to the mast is thus realised in a simple manner.

It has already been explained with reference to the above-mentioned EP 0 155 012 A1 that mast forms are also known which have profiling that differs from the circular shape, for example in the form of a drop profile, and which also include a corresponding groove for anchoring a sail at the tapering end of the drop profile. The prior art only provides for the mast to be provided with a corresponding groove over the total length thereof, without exceptions; therefore, by way of derogation from the present invention, there is no portion preferably comprising a rotational profile such that, in this case, an anchorable pivoting body can be attached for receiving a boom head, which body can be freely pivoted with respect to the mast. In the conventional solution, the boom is intended to be connected to the mast for conjoint rotation.

In addition, in this previously known prior art, as already mentioned, the mast is consistently a mast that runs straight and which, in contrast with a preferred embodiment of the invention, is not inherently arcuate.

The above-mentioned EP 0 155 012 A1 also deviates from the present invention because, in the above-mentioned prior publication, it is not only the case that previously known solutions having a circular mast cross section and also a profiled mast cross section (forming a drop profile) are described as previously known, but rather, by way of derogation therefrom, a mast having a round cross section that is lined and clad with an auxiliary means is proposed as a comparatively improved solution. This cladding includes a leading edge part arranged so as to be leading on the mast, which part laterally passes the mast, which is hollow-cylindrical in cross section, and transitions into a taper that is drop-shaped in cross section to the rear of the mast, in the interior of which taper the batten pockets having the battens inserted therein terminate.

The invention offers a range of advantages in contrast therewith.

One of the advantages is the use of a mast that is profiled in cross section, it being possible to ultimately hang the sail at the tapered end of the mast having a drop profile, at the groove provided therein, which is known in principle. Proceeding therefrom, the advantage is achieved whereby a mast sleeve can be omitted, and therefore it is easier to draw the rig out of the water since water which would have to be lifted together with the mast sleeve cannot accumulate in said sleeve.

In the context of the invention, however, it is further provided for the profiled cross section of the mast not to be realised over the total length, however. The mast is preferably cylindrical at least in the height region or portion in which the boom, i.e. in particular a boom head, is fastened. Preferably a bush, a sleeve and/or clamping jaws, for example, are provided here, such that a boom, in particular a boom head (i.e. a boom front arch), can be anchored at this point so as to be able to rotate about the mast by means of a boom-mast fastening means on said mast. In other words, there is no connection for conjoint rotation between a boom and a mast in this case that nevertheless allows relative rotation or pivoting at least in a region around the mast.

The boom is therefore preferably fastened to said bush or the like by means of said boom-mast holding means, which bush is penetrated by the mast in the fastening region of the boom head. Said boom-mast holding means is therefore preferably rotatably mounted on a portion of the mast that allows a rotation or rotational movement and that has a preferably cylindrical cross section, which results in the advantage of the sail folding over on account of slight wind pressure, meaning that an aerodynamically perfect transition from mast to sail is consistently realised in any given situation.

Said means is rotatably mounted in a cylindrical recess in the mast and makes it possible for the sail to fold over on account of slight wind pressure, an aerodynamically perfect transition from mast to sail being consistently achieved in any given situation.

The mast itself preferably does not run straight, but rather is crescent-shaped or crescent-like in side view.

In addition to the use of the mast that is profiled in cross section, a mast of this kind that is pre-bent or permanently bent offers the possibility of feeding through the luff by means of gentle traction (not as is the case with conventional sails, in which the mast has to be bent by extremely vigorous feeding-through of the luff). In addition, profile-supporting sail battens can be supported directly on the mast.

Overall, only minor clamping forces are required in order to make it possible to have a corresponding belly on the sail.

Finally, the mast according to the invention can also be separable, preferably in the region or portion in which the boom or boom head is fastened to the mast.

The above-mentioned preferably bush-shaped or bush-like connection element comprises a channel-shaped receiving portion having a preferably circular inner cross section by means of which said connection element is rotatably arranged on the corresponding cylindrical mast portion, i.e. is preferably arranged so as to be able to freely rotate at least in a partial angular range.

The boom, i.e. the boom head, can be fastened to said rotatable connection element using suitable measures. This ensures that the boom head can rotate relative to the mast, i.e. is held so as to be able to pivot relative to the mast, at least indirectly by means of the preferably bush-shaped connection element.

Said preferably bush-shaped or bush-like connection element, which can be or is attached so as to be able to rotate or pivot about the mast in said fastening portion for a boom, may be a separate connection element to which, for example, said boom-mast holding means can be attached in turn. It is also possible, however, for said boom-mast holding means itself to include a corresponding bush-like or bush-shaped connection element and to be provided as an integral component that is mounted so as to be able to pivot about the mast, as explained, and is ultimately used to anchor a boom head. In this case, in a further embodiment that is an alternative in this respect, said preferably bush-shaped or bush-like connection element is also provided with an external thread. Said inner hole in the boom-mast holding means is further equipped with an internal thread, such that the bush inserted into the mast-receiving opening is rotatably arranged in said mast-receiving opening by means of the threaded engagement. This allows the height of the fastening point of a boom head to be adjusted relative to the mast height simply and without difficulty.

Even if the connection element does not consist of a threaded bush, but rather consists of a simple bush that can rotate on the mast or relative to the mast in the circumferential direction, this also offers the possibility of being able to fasten the boom head in various height positions on said bush, thus ultimately in various height positions on the mast. This is because the boom head can be simply fastened over the entire axial length of the bush, making it possible to achieve height setting or height fixing of the boom head relative to the mast.

In other words, this ultimately allows an optimum aerodynamic transition from mast to sail. The desired sail belly be can thus be achieved even at the lowest sail pressure.

Finally, the low trimming forces obtained according to the invention contribute to considerable savings in weight. This is because it is possible:

- to provide less sailcloth,
- to use a thinner sail,
- to use lighter sail battens,
- to omit trim blocks
- to considerably reduce the water intake before a water-start (omission of the mast sleeve), as a result of which the rig according to the invention can also be produced at a considerably reduced cost.

The invention is described in more detail in the following with reference to the drawings, in which:

FIG. 1 is a schematic side view of a rig of a surfboard;

FIG. 2*a* is a schematic side view of a separable mast according to the invention;

FIG. 2*b* is a similar view to FIG. 2*a* with the mast dismantled;

FIG. 2*c* shows an enlarged detail of a region of the mast, and also shows a bush;

FIGS. 3*a* to 3*d* are different cross sections through the mast at various heights of the mast;

FIG. 3*e* is a modified cross-sectional view through the mast in the region of the boom-head fastening portion;

Figure 7A:
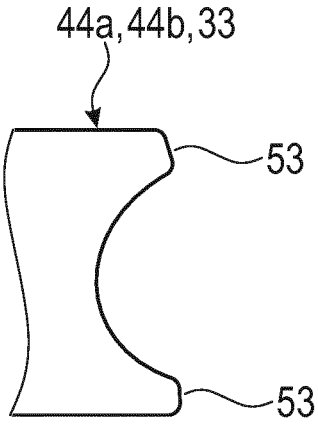
Figure 7B:
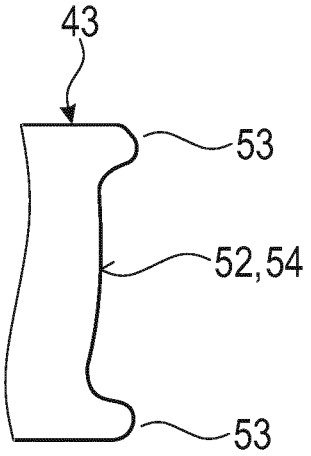
Figure 8:
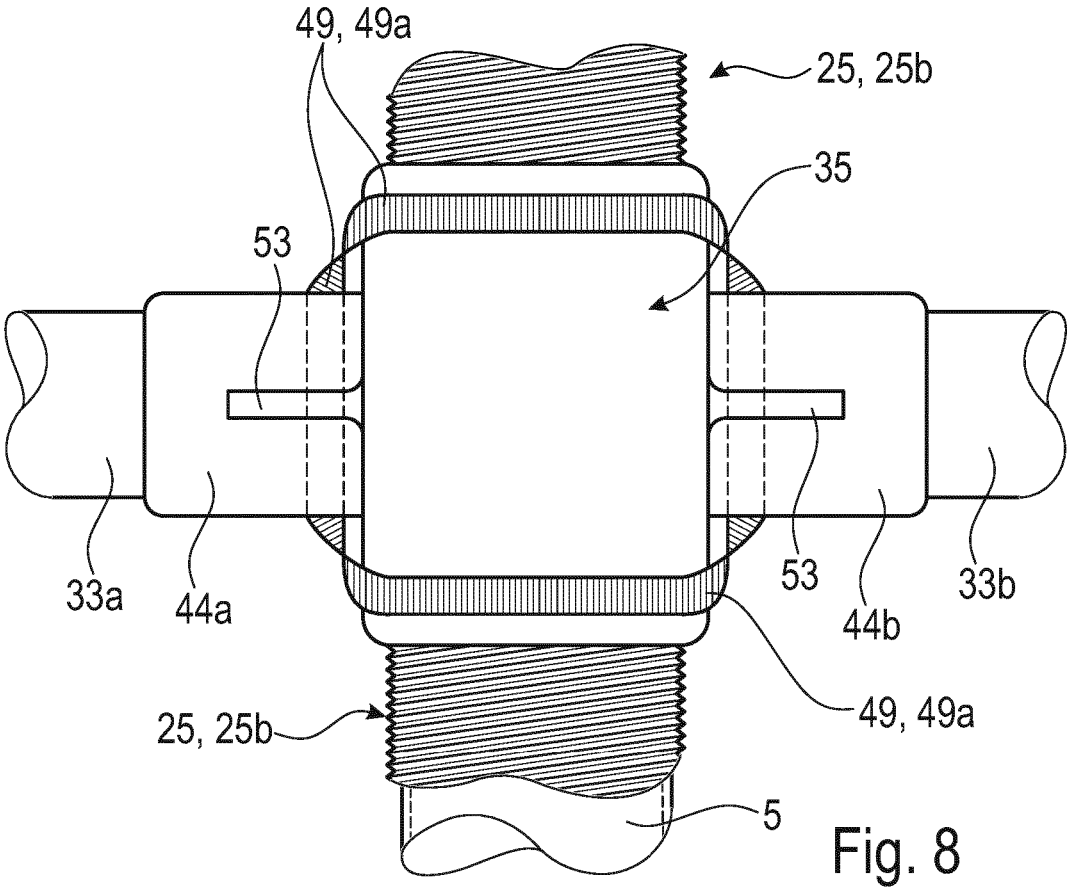

FIG. 7*a* shows a detail of a schematic cross section (in parallel with the mast) which depicts the design of the lateral abutment portions of the mast holder for abutting the boom head;

FIG. 7*b* is a view corresponding to FIG. 7*a* showing the central abutment portion of the mast holder for abutting the boom head;

FIG. 8 is a schematic rear view of a modified embodiment with a height-adjustment means for the boom head.

Figure 1:
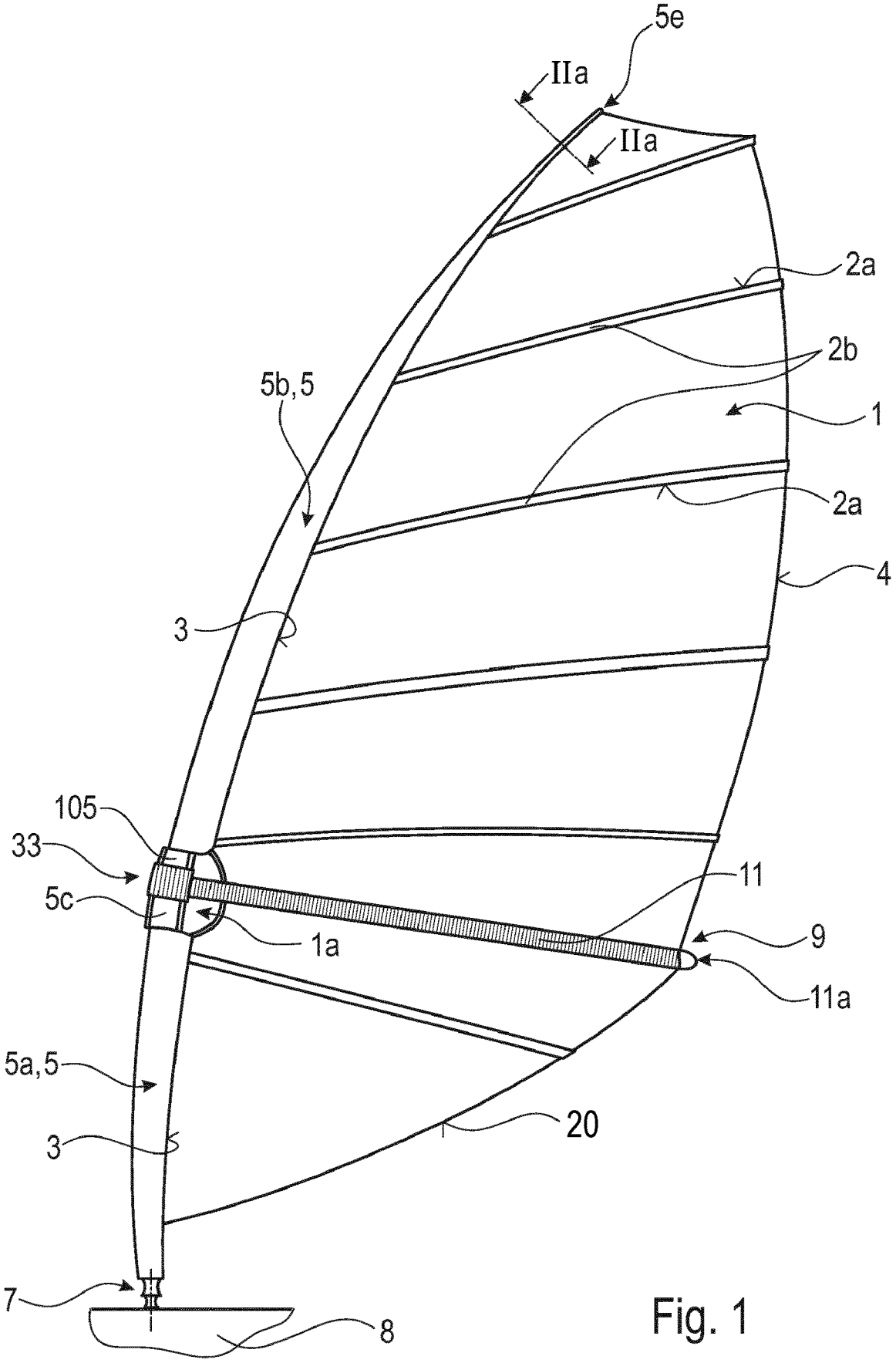

FIG. 1 is a schematic side view of a rig comprising a sail 1. In this case, the sail is fastened at its luff 3 to a mast 5, which in turn is freely, on all sides, rotatably and pivotally arranged on a surfboard 8 (of which only an excerpt is shown) by means of a mast foot joint 7 (universal joint 7).

A sail 1 of this kind is usually trimmed at its rear end 9, thus at what is known as its clew 9, at a boom 11 that surrounds the sail 1, i.e. at the boom end 11*a*.

The schematic side view according to FIG. 1 also shows that the sail comprises batten pockets 2*a* that are offset with respect to the longitudinal direction of the mast and extend from the luff 3 to the leech 4 (or also at least in part to the foot 20) and that are sewn into the sail 1, in which pockets the corresponding battens 2*b* for reinforcing the sail are typically inserted.

Said mast 5 can in principle consist of a straight-running mast. In the context of the invention, however, a permanently bent mast 5 is preferably used. The bend at the top end of the mast 5 is usually more pronounced than in the bottom portion of the mast 5. In other words, the mast is therefore curved or curved more significantly at least in portions, preferably at least towards the top end thereof. The curvature can also be referred to simply as being crescent-shaped or crescent-like, irrespective of the fact that conventional crescents usually exhibit a considerably more pronounced curvature than the mast 5 shown in side view in FIG. 1. This ultimately makes it possible to have a larger sail surface area without the height of the sail having to be increased. This means that it can also be ensured that the holding force does not substantially increase against the wind pressure.

On account of said trimming at the rear end of the sail, said mast irrespective of whether it is designed to run straight or is inherently slightly arcuate, thus permanently bent is bent further in marginal, steady increases on account of the applied trimming forces, at least in the top region.

A corresponding recess 1*a* in a sail 1 is usually provided over a partial length of the mast 5 at which the leading boom end 33 is fastened to the mast 5, such that the leading boom end can preferably (at least indirectly, as explained in the following) be fastened to the free mast.

It should be noted at this point that the mast 5 comprises a straight-running portion in said fastening region in which the boom head is preferably indirectly fastened to the mast 5. Said straight-running fastening portion 105 on the mast is, however, not only provided if the mast as a whole runs straight, but also if (as is preferred and shown in FIG. 1) the mast is inherently, thus permanently, curved in the substantial longitudinal extension thereof.

Figure 2A:
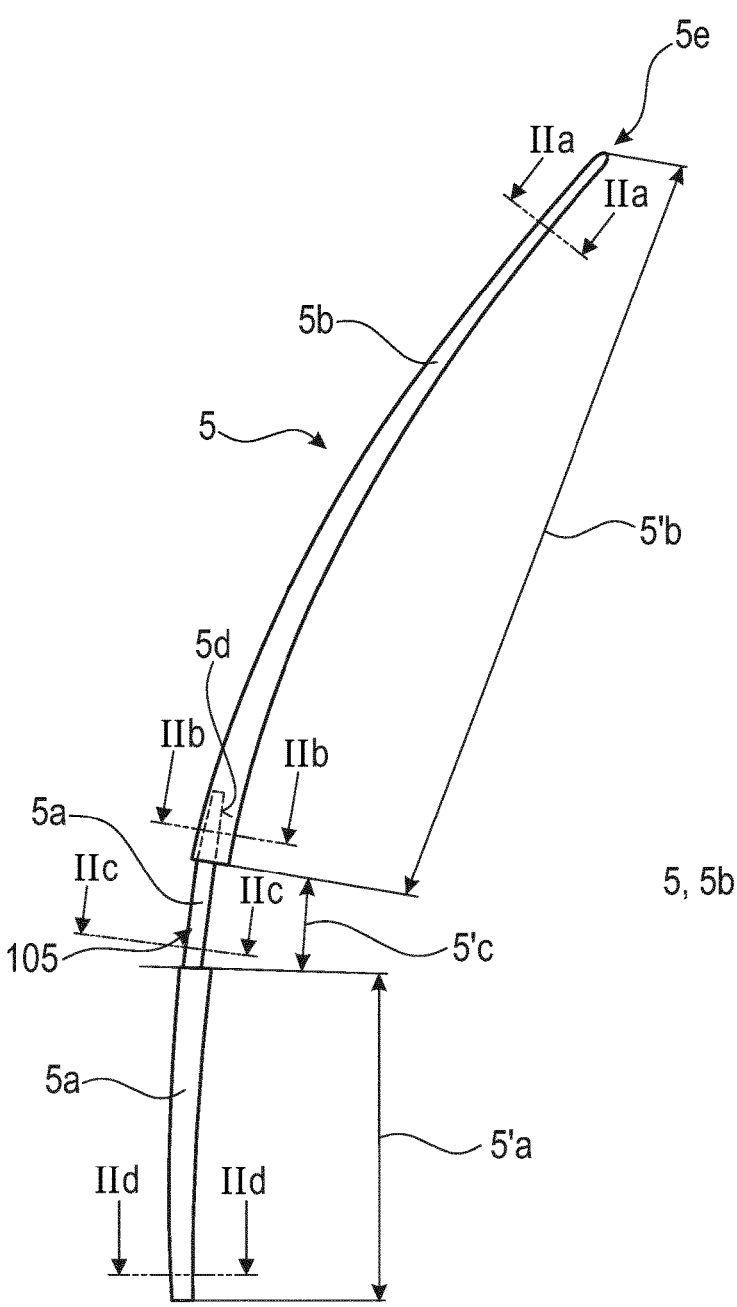

FIG. 2*a* is a schematic side view of a preferred variant of the mast 5 without a corresponding sail and without a boom. It is clear from this variant that the mast 5 is ultimately divided into three portions, specifically into a bottom mast part 5*a* having a length 5'*a*, into an top mast part 5*b* having a length 5'*b* and into a mast connection portion 5*c* that connects the bottom mast part 5*a* and the top mast part 5*b* and has a length 5'*c*. Said mast connection portion 5*c* can also be rigidly connected to/formed together with either the bottom mast part 5*a* or the top mast part 5*b*, and is preferably integral therewith. In the embodiment shown, the mast connection part 5*c* is a fixed component of the bottom mast part 5*a*, as is clear from the schematic side view according to FIG. 2*b*. This is because the mast 5 is shown dismantled in FIG. 2*b*.

Said mast connection part 5*c* simultaneously forms the boom-head fastening portion 105 to which a boom head of a boom (to be explained in more detail in the following) can be attached and held.

For this purpose, the top mast part 5*b* comprises a channel-shaped receiving opening 5*d* which, in the embodiment shown, can be designed as a round hole or a blind hole. In this case, the mast connection portion 5*c*, which is preferably cylindrical in cross section, is inserted into the bottom end of the top mast part 5*b*, and is preferably inserted so as to be restricted by a stop, until the two parts are interconnected. At this juncture, reference is briefly made in advance to FIG. 2*c*, which shows, as a detail, the bottom end of the top mast part 5*b*, the top end of the bottom mast part 5*a* positioned at a distance therebelow, and the mast connection part 5*c* positioned therebetween, on which connection part a rotary body 25 is arranged and held so as to be able to rotate or pivot relative to the mast, which will be discussed in more detail in the following.

The mast 5 formed and capable of being dismantled in this manner is ultimately held by the raised and trimmed sail 1, with the components of said mast being bound tightly together.

Different cross sections along the lines IIa-IIa, IIb-IIb, IIc-IIc and IId-IId in FIG. 2*a* are reproduced in FIG. 3*a*, FIG. 3*b*, FIG. 3*c* and FIG. 3*d*.

It can be seen therefrom that the actual mast 5 comprises a profile that differs from the circular shape, and in particular has an at least approximately drop-shaped or drop-like cross section. On account of this drop-shape in cross section, the mast 5, on its leading side 15, is generally convex, in the shape of a part-circle, and has a portion 19*a* that is in the shape of a semicircle or like a semicircle in cross section, i.e. is preferably in the shape of a semicircle, which portion then, at the trailing end 17 thereof, transitions into a portion 19*b* that steadily tapers in cross section, in the trailing end of which a groove 22 is made having an undercut 21. The arcuate shape 19*a* in the leading portion 15 of the drop-shaped mast profile can, however, have any desired radius or can even have an arbitrarily variable radius within wide limits. Aerodynamic shapes are preferably realised in the process.

Figure 3A:
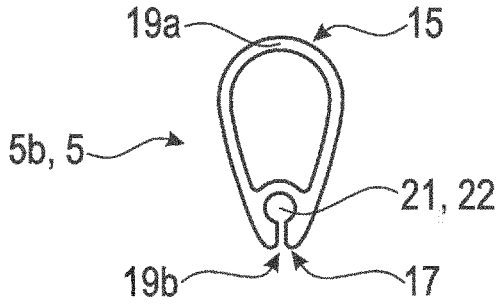
Figure 3B:
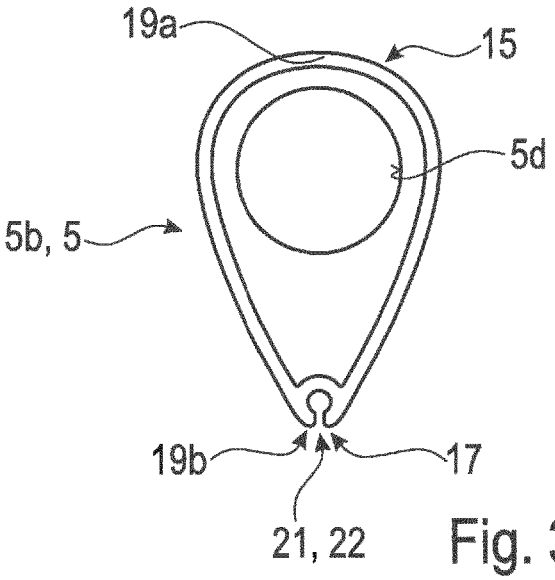

The cross-sectional view according to FIG. 3*b* shows that this cross-sectional view preferably has the largest transverse and longitudinal extension, i.e. in the region of the end face regions of the top mast part and the bottom mast part, which are intended to be placed one on top of the other. In other words, the top end of the bottom mast part 5*a* and the bottom end of the top mast part 5*b*, each adjoining the mast connection portion 5*c*, usually have the largest longitudinal and transverse extension, i.e. just in the direction of the sail 1 or in the direction transverse thereto. Said mast cross section is then dimensioned so as to be considerably smaller at the top mast end, i.e. at the mast top 5*e*. Similarly, the bottom mast part 5*a* can also be designed to have a mast cross section that tapers gradually or in portions from the mast connection portion 5*c* to the mast foot, at least to a small extent, as shown by FIG. 3. However, this can also be omitted, such that the bottom mast part has a more or less even cross section over the entire length thereof, but can nevertheless be provided with a cross section that becomes increasingly larger towards the mast foot. Arbitrary modifications are possible in this case.

Figure 3C:
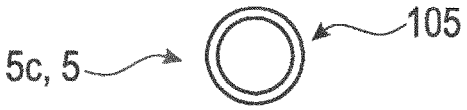
Figure 3D:
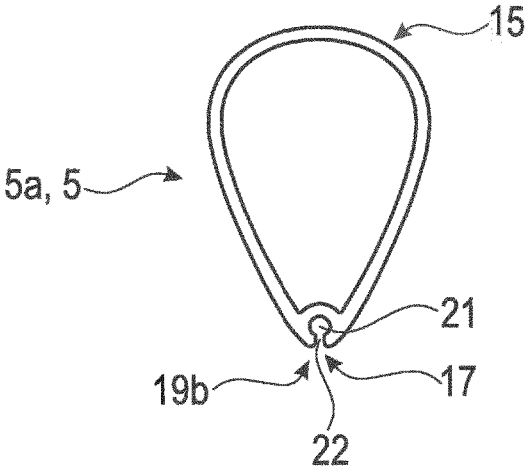

The cross-sectional view according to FIG. 3*c* shows that the mast connection portion 5*c* in turn has or can have a cylindrical or hollow-cylindrical shape. In general, a cross-sectional shape is preferred that allows a body allowing rotation or pivoting to be placed, which body can then be rotated or pivoted about said fastening portion 105.

Figure 3E:
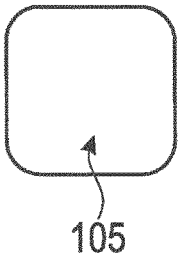

The schematic cross-sectional view according to FIG. 3*e* shows, as an alternative to the circular cross section according to FIG. 3*c*, that other cross sections differing from the circular shape are also possible for the boom-head fastening portion 105. Axially symmetrical cross-sectional shapes are preferably realised. FIG. 3*e* shows that for example a fairly square cross-sectional shape having appropriately rounded corners can be used, such that a bush or corresponding sleeve- or clamping-jaw-shaped abutment portions 39 placed here can be supported on said for example rounded edges or corners of the boom-head fastening portion 105 provided with a cross section of this kind. This also allows a rotation of the bush 25 about the boom-head fastening portion 105 with as little clearance as possible. Further arbitrary modifications are possible in this respect.

The luff 3 of the sail 1 can be pushed into said groove 22, formed in the mast over the total length thereof (with the exception of the length of the mast connection portion 5*c*), by means of a thickened edge in the longitudinal direction of the groove 22, and can thus be securely anchored to the mast 5. Here, said recess 1*a* in the luff 3 of the sail 1 comes to abut the trailing side 17 of the mast in the region of the mast connection portion 5*c*.

A mast of this kind is preferably made from plastics material that is sufficiently stable, but at least still slightly elastically deformable, in order to be able to trim a corresponding sail. The mast preferably consists of CFK material, i.e. of carbon fibre plastics material or carbon fibre reinforced plastics material. This particular design also allows the mast according to the invention to have an inherent, at least slightly arcuate, i.e. crescent-shaped or crescent-like, design with a permanent curve, which results in significant advantages for the invention.

Figure 2B:
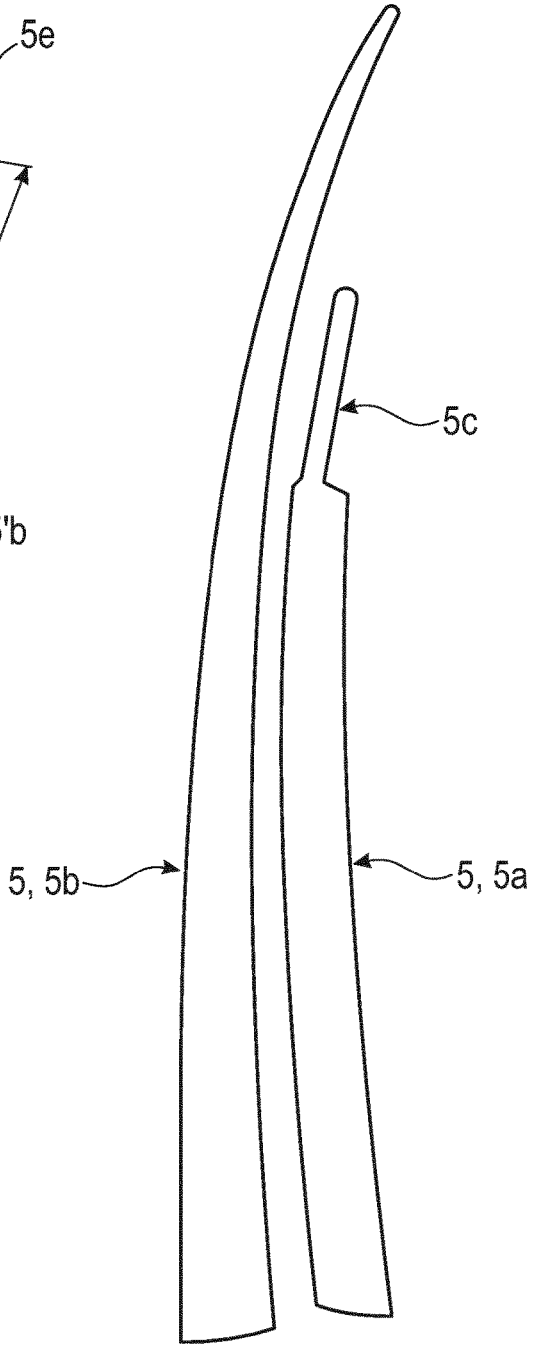

As can be seen from the side view according to FIGS. 2*a* and 2*b*, said mast 5 is preferably broadly curved, i.e. is slightly curved over at least portions of its length, resulting in a crescent-shaped or crescent-like form. In other words, the mast is arcuate or at least slightly arcuate, preferably continuously arcuate, from its foot to its upper mast top, at least over its significant longitudinal extension portions, it being possible for a straight-running portion to be provided in particular towards its foot end. However, if the mast is inherently (i.e. permanently) curved so as to be arcuate or includes arcuate curved portions, the mast connection portion 5*c*, which ultimately forms a fastening portion 105, runs straight, i.e. is not curved. This allows the possibility for a pivoting body in the form of the boom-mast holding means 35 to be able to be placed on the fastening portion 105 by means of a receiving hole 37 or a receiving channel 37 (FIGS. 4 and 5) such that the boom-mast holding means 35 can be rotated or pivoted about the mast connection portion 105 on account of the straight-run of said mast connection portion 105. The advantages resulting therefrom are discussed in more detail below.

Figure 2C:
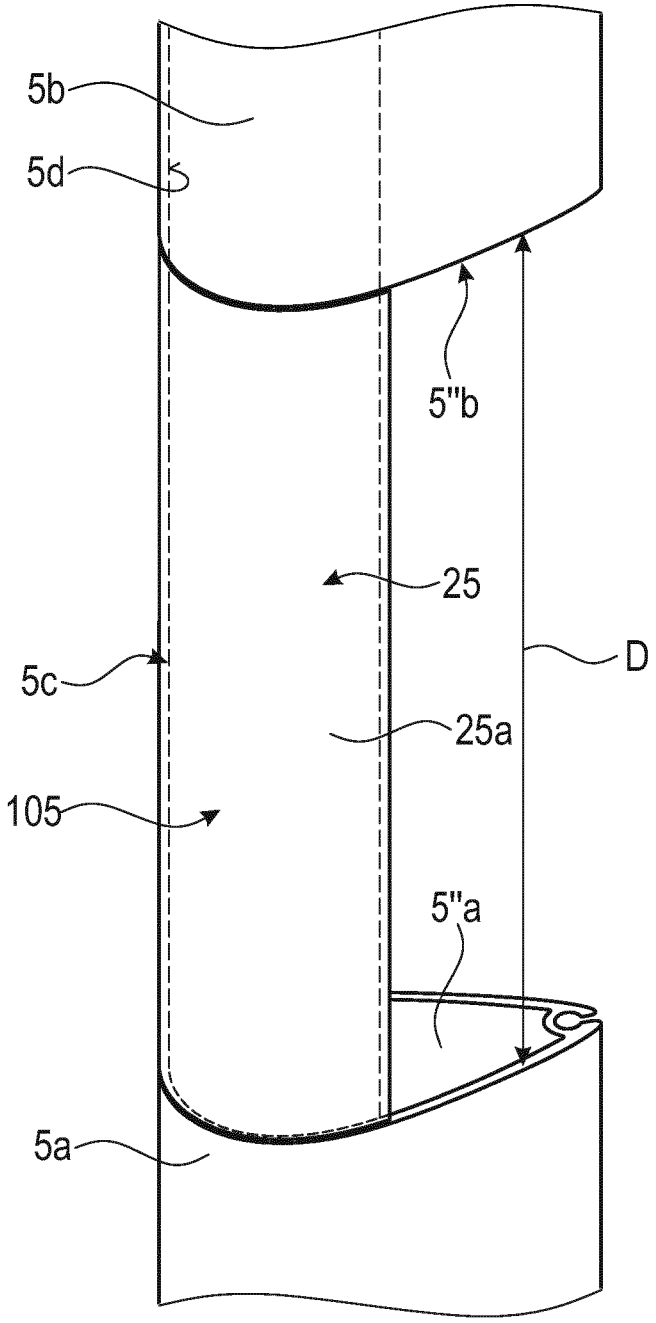

FIG. 2*c* shows, as already discussed, an enlarged detail of the mast connection portion 5*c* and the bottom mast part 5*a* and top mast part 5*b* adjoined thereto in perspective view.

It can already be seen therefrom that, on the mast connection portion 5*c* connecting the bottom mast part 5*a* to the top mast part 5*b*, a rotary body 25 that can rotate on said portion, in particular that can freely rotate in at least one angular range around the mast 5, is arranged, in particular is fitted therein.

The length of said rotary or pivoting body 25 is preferably such that it is at least slightly shorter than the distance D between the top end face or limiting face 5"*a* of the bottom mast part 5*a* and the downward-facing end face or limiting face 5"*b* of the top mast part 5*b*. Said distance D is produced when the mast, with its two parts 5*a* and 5, is put together according to the view in FIG. 2*a*. As a result, the rotary body 25 can be rotated or pivoted about the axis of the mast connection part 5*c* or at least can be freely rotated and/or pivoted by a certain angular measurement. At the same time, the pivoting body 25 is held in a manner restricted by a stop so as to be more or less immovable in the axial direction (apart from a low level of clearance which may be provided).

In the preferred embodiment according to FIGS. 1 to 3*d*, the mast 5, i.e. at least the mast connection portion 5*c*, passes through the receiving hole 5*d* penetrating the rotary body 25, it being possible for said rotary body 25 to preferably be in the form of a bush 25*a* or, as disclosed hereinafter, in the form of a threaded bush 25*b*. Said bush-shaped rotary body 25, together with the receiving hole 5*d* thereof, runs straight, just as with the mast connection portion 5*c* passing therethrough, and is therefore not arcuate, such that the above-mentioned desirable rotational or pivoting movement of the rotary body 25 relative to the mast or mast axis is possible here. In other words, the inner diameter of the receiving hole 5*b* in the pivoting body 25 is preferably at least slightly larger than the outer diameter of the mast in this fastening region, thus at least slightly larger than the outer diameter of the mast connection portion 5*c*. The fit, however, is intended to be as free of clearance as possible.

In the following, a fastening, according to the invention, of the boom to the mast is explained with reference to further drawings.

Figure 4:
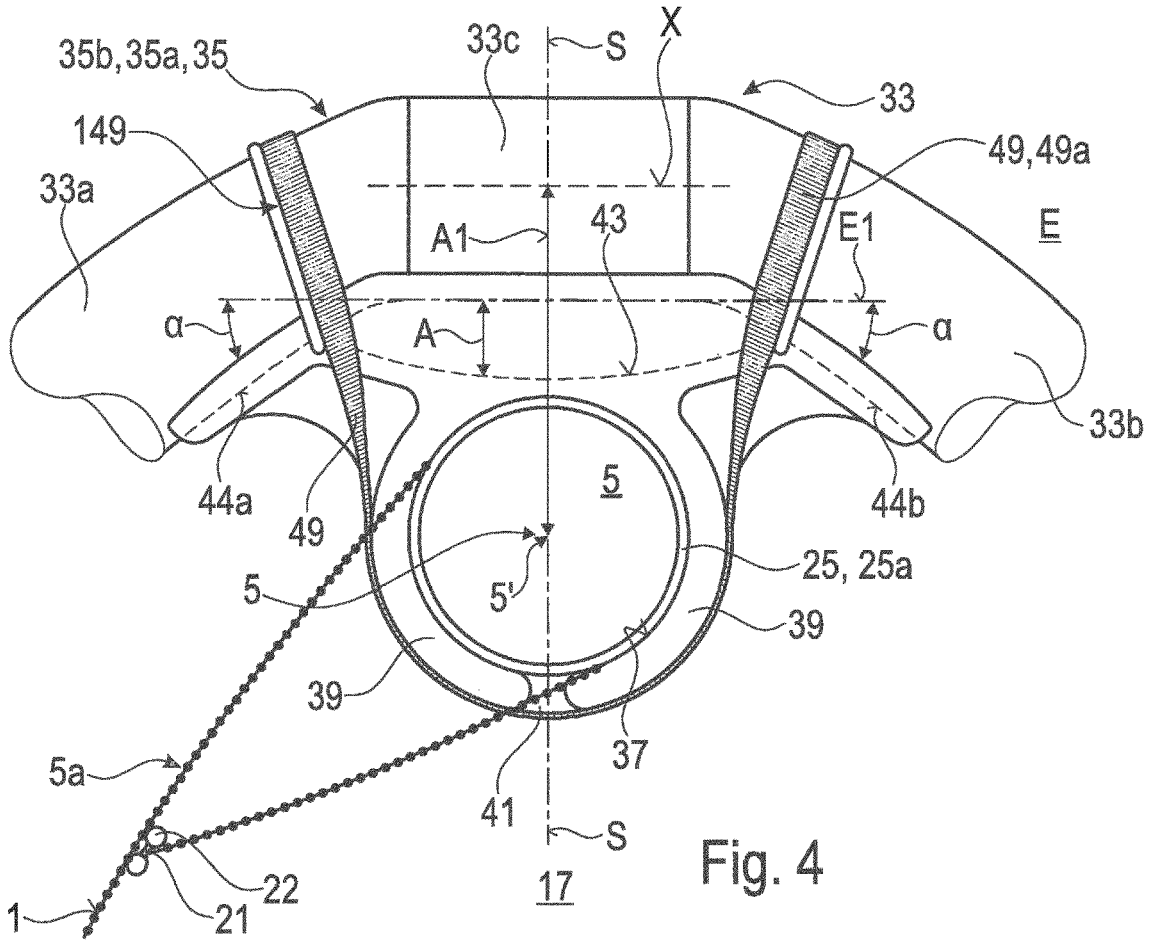
FIG. 4 is a schematic plan view of a boom-mast holding means 35 by means of which a boom can be rotatably fastened with respect to the mast, in particular in the fixed position.

FIG. 4 is a cross section, shown as a detail, through the mast 5 in the region of the mast connection portion 5*c*, specifically directly above the front boom end, which is hereinafter also referred to as the boom head 33 or the boom front arch 33. The variant according to FIGS. 4 and 5 relates to a first embodiment of a possible boom-mast fastening. According to this embodiment, the boom-mast fastening and/or holding means includes a boom-mast holding means 35 preferably consisting of plastics material. In particular, said boom-mast holding means 35 is produced in the form of an integral plastics part 35*a*. Said boom-mast holding means 35 is hereinafter also referred to occasionally as the boom-mast holding means 35.

Said boom-mast holding means 35 having a holding body 35*b* comprises a mast-receiving opening 37. In other words, the mast 5 shown in FIG. 1 extends, at least in the region of the cross-sectional view according to FIG. 4, perpendicularly to the drawing plane E. In the unloaded initial position, i.e. in particular without wind, the mast 5 extends in the symmetry plane or centre plane S indicated by dashes in FIG. 4, and is usually bent backwards, thus towards its rear or trailing end 17, from its bottom mast foot joint 7 to its upper mast tip 8.

Said boom-mast holding means 35 is sleeve-, clamping-jaw- or bush-shaped and includes at least two opposing holding portions 39 which, when assembled, ultimately at least indirectly surround the mast 5 extending through the mast-receiving opening 5 in the embodiment shown. The mast 5 is thus indirectly surrounded because said rotary body 25, in the form of a bush 25*a*, is placed on the mast 5 in the region of the mast connection portion 5*c* and can be freely rotated there. The bush 25*a* is shown in side view according to FIG. 2*c*. In this case, the arrangement according to FIG. 4 can be such that the jaw-, sleeve- or bush-shaped holding portions 39 are not circumferentially closed, but terminate on the trailing side 17 thereof so as to be mutually spaced, preferably on either side of the symmetry plane S, as a result of which a trailing distance or slot 41 is formed.

On the leading side 15, the boom-mast holding means 35, in the cross section shown in FIG. 4, is designed to be T- or π-shaped or to have the shape or resemblance of double-wings perpendicularly to the centre axis 5' of the mast 5 (at least in the region of the mast-receiving opening 37), with, in addition to a central boom abutment portion 43, lateral boom abutment portions 44*a* and 44*b* being adjacent thereto.

The central boom abutment portion 43 can for example have a length (in the drawing plane E), perpendicular to the symmetry plane S, that is in the order of magnitude of the diameter of the mast-receiving opening 37. Values that are, for example, above 40%, in particular above 50%, 60%, 70%, 80%, 90%, 100%, 110%, 120%, 130% or 140% of the diameter of the mast-receiving opening 47 are particularly suitable in this case. Conversely, this width or length of the central boom abutment portion 43 is intended to be smaller than 150% of the diameter of the mast-receiving opening 17, thus in particular smaller than 140%, 130%, 120%, 110%, 100%, 90%, 80%, 70%, 60% or smaller than 50% of the diameter of the mast-receiving opening 37.

The length of each of the lateral boom abutment portions 44*a*, 44*b* can be designed to be in a corresponding order of magnitude, which portions are oriented so as to be symmetrical to the symmetry plane S and are slightly trailing with respect to the central boom abutment portion 43, and thus diverge significantly from one another. The angle α between the abutment flanks 44*a*, 44*b* of the corresponding boom portion that are sloping in the trailing direction and a plane E1 that extends in parallel with the mast axis 5' (i.e. at least in the mounting region of the boom or the mast axis 5' of the mast connection portion 5*c*) and perpendicularly to the symmetry plane S is designed to correspond, at least approximately, to the profile of the boom. Such an angle can usually vary in this region between 10° and 60°, in particular 20° and 40°, etc. There are no restrictions in this respect.

Said two lateral boom abutment portions 44*a*, 44*b* can also be designed to be slightly convex towards the leading end thereof, according to the profile and shape of the boom front arch 33, which is often also referred to as the boom head 33.

Finally, the view in FIG. 4 shows that a tension element 49 is also provided, in the form of a closed circumferential belt 49*a* in the embodiment shown. Any possible embodiment for a continuous tension belt 49 that, as far as possible, is not extensible, i.e. is not resilient, and can absorb large tensile forces can be considered in this case.

In the embodiment shown, the belt loop 49, having a specified, defined length, surrounds the boom to the left of the symmetry plane S and to the right of the symmetry plane S in order to surround the outer circumference of the jaw-, sleeve- or, for example, bush-shaped mast abutment portion 39 of the boom-mast holding means 35 in an upper and a lower plane.

FIG. 4 shows the boom 11 together with the boom front arch 33 thereof in the tensioned position in which it is fixed to the fastening portion 105 of the mast 5. In this position, the two lateral boom front arch lateral portions 33*a* and 33*b*, in the region of the trailing outer wall portion thereof, abut, at least in part, the corresponding leading abutment portions in the region of the lateral boom abutment portions 44*a* and 44*b*. In this position which will be explained in more detail in the following the leading boom front arch central portion 33*c*, on its trailing side, is raised by a corresponding central boom abutment portion 43 of the holding body 35*a* of the boom-mast holding means 35, forming a distance A. Here, A1 denotes the length of the distance between the centre of the boom front arch central portion 33*c* and the centre of the mast-receiving opening 37. The significance of the distance A or the length of the measurement A1 is discussed in more detail below.

FIG. 4 shows, for example, the relative position of the boom or boom head with respect to the boom-mast holding means 35, the sail bulging, in particular also under wind load (coming from the right-hand side in FIG. 4), for example to the left and the entire mast 5 and the centre axis 5' thereof being rotated clockwise in the process such that the drop-shaped profiling of the bottom mast part 5*a* (and also of the top mast part 5*b*) shown in FIG. 4 is rotated clockwise to the left in the view according to FIG. 4. Points are also inscribed at the profile end in order to indicate which position the sail 1 extending therefrom adopts. It can already be seen therefrom that an optimum contour between the profiled mast and the adjoining sail is produced, meaning that optimum (turbulence-free or low-turbulence) propulsion forces can be produced.

Figure 5:
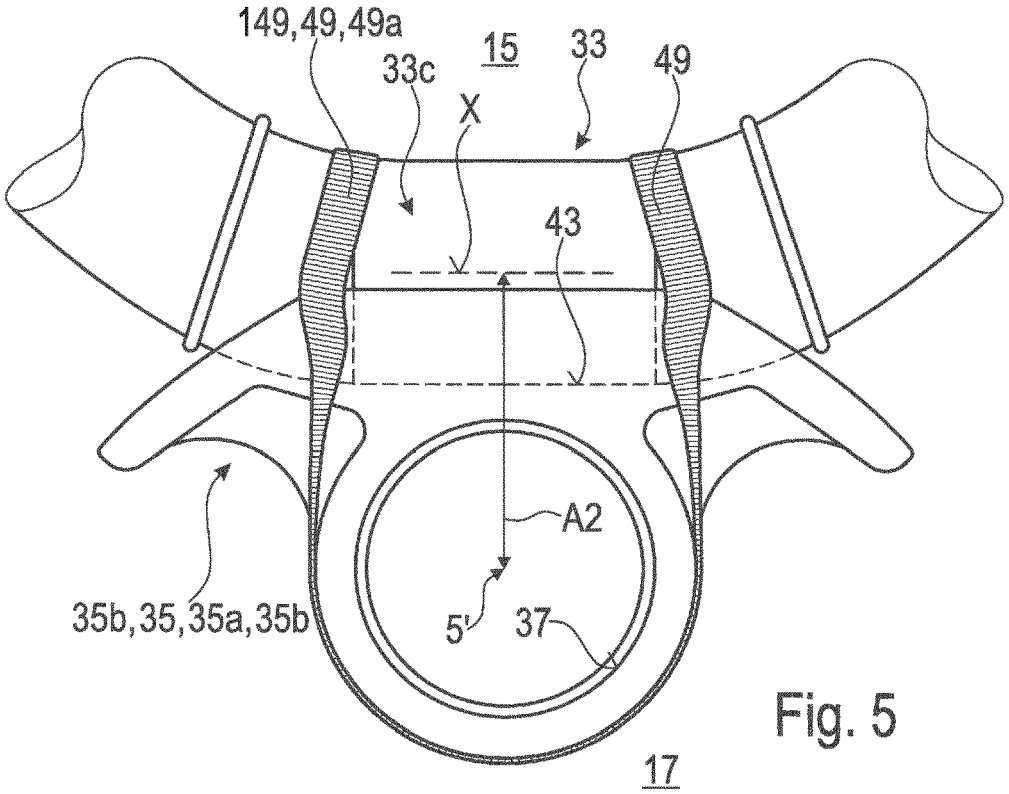
FIG. 5 is comparable view to FIG. 4, in which the boom has been pivoted forwards from its functional position beneath the mast end into the released position thereof.

FIG. 5 shows, with respect to FIG. 4, the position of the boom or of the boom front arch before the boom is rigidly locked to a mast.

Figure 6:
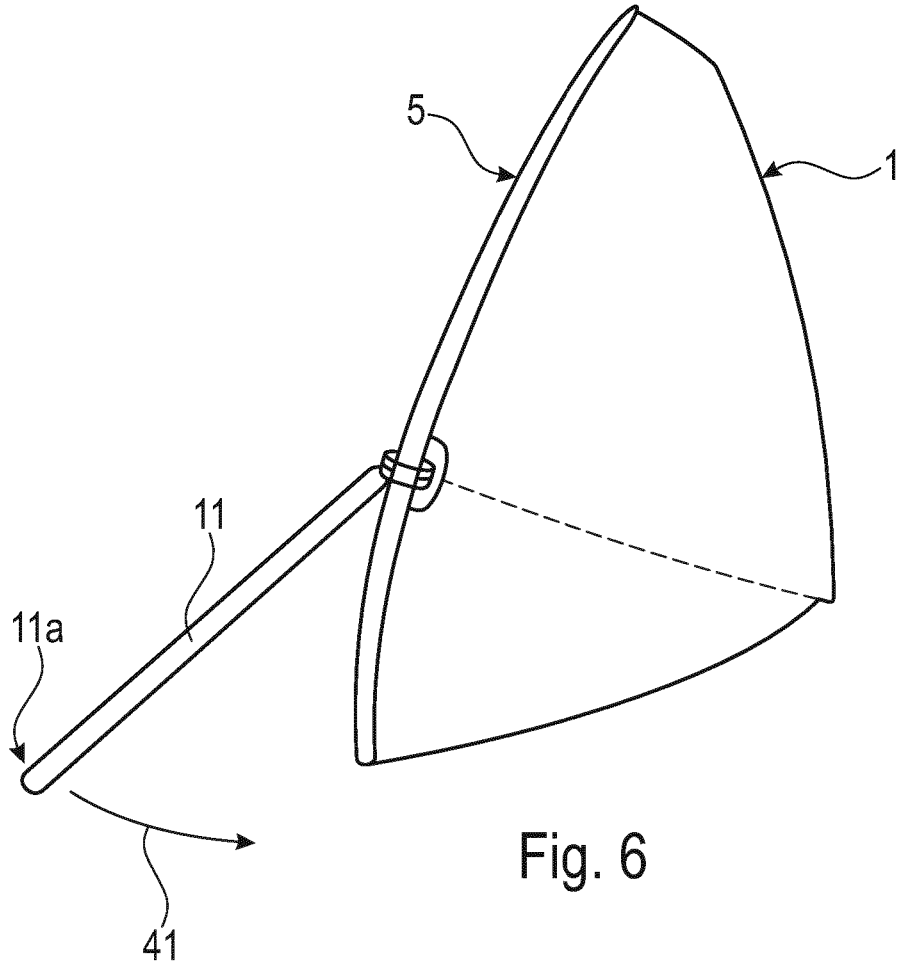
FIG. 6 is a schematic side view in which the boom has been pivoted into the non-engagement position (released position) thereof in front of the mast.

FIG. 6 is a side view of the boom, which has been pivoted from the functional position thereof shown in FIG. 1 (i.e. before trimming at the clew, thus at the boom end) beneath and beyond the mast foot 5 of the mast 1 into a leading position.

In this initial situation before trimming, the two boom front arch lateral portions 33*a* and 33*b* are therefore raised by the corresponding lateral boom abutment portions 44*a*, 44*b* of the boom-mast holding means 35 such that only the boom front arch central portion 33*c* can abut a corresponding central abutment portion 43, but does not have to. This is because, in this initial position, the boom front arch central portion 33*c* comes to be positioned closer to the centre 5' of the mast-receiving opening 37 and thus of the mast 5, and therefore said tension belt 49, for example the circumferentially closed belt 49*a*, is no longer under tension, but has a loose circumferential fit, as shown in FIG. 5. In this position, the boom 11, through which the corresponding winding of the belt 49*a* passes, can be rotated without difficulty, i.e. without difficulty about an axis that extends perpendicularly to the centre axis 5*a* of the mast and that extends in or approximately in the drawing plane E.

The distance between the centre of the boom front arch central portion 33*c* and the centre 5' of the mast-receiving opening 17 (and thus the centre of the mast 5) is denoted by reference sign A2. This measurement, A2, is considerably smaller, thus shorter than the longitudinal measurement A1 in FIG. 4.

In order to rigidly fix the boom 11 to the mast 5, the boom 11 ultimately has to be pivoted from the position thereof shown in FIG. 6 (in which the entire boom 11 is leading in front of the mast with respect to its final functional position) and, in terms of the side view according to FIG. 6, pivoted anticlockwise following the arrow 41 within the tension element 49 (belt 49) until the boom end 11*a* thereof is in the functional position shown in FIG. 1 and indicated by dashes in FIG. 6. During this pivoting movement about the pivot axis X passing through the boom front arch central portion 33*a* in the longitudinal direction thereof, the two boom front arch lateral portions 33*a* and 33*b* run on the lateral boom abutment portions 44*a* and 44*b*, respectively, of the boom-mast holding means 35, as a result of which the boom front arch central portion 33*c* is raised by the corresponding central boom abutment portion 43. This means that the tension element 49, preferably in the form of the belt 49*a*, is accordingly taken therewith and tensioned. Since the length of the belt 49*a* is defined precisely such that the final tension position shown in FIGS. 1 and 4 can be achieved, but only in conjunction with a rigorous application of tensioning forces to the tension belt 49, the optimum fixing of the boom 11, i.e. the boom head 33 to said rotary body 25, is in this case realised in the form of the bush 25*a* that is held with as little clearance as possible on the corresponding portion 5*c* of the mast 5, but is also held so as to be able to rotate or pivot thereon. It can also be seen from FIG. 4 that the distance A1 between the centre of the boom front arch central portion 33*a* and the centre of the mast-receiving opening 37 is now considerably larger than the length of the distance A2 according to FIG. 5, as a result of which the large tensioning forces that are required are produced in co-operation with the tension belt 49. Said tension element 49, preferably in the form of the tension element 49 or the belt 49*a*, fulfils the function of a boom holding means 149 in this respect.

What is interesting and significant in this connection is that, by means of said fastening means, the boom head 33 can be fastened at various points, i.e. at various height positions, to the rotary body 25, which in this case is in the form of said bush 25*a*. This is because the fastening means always operates between the boom head 33 and the bush. On account of the variable fastening point of the rotary body 25, in particular in the form of the bush 25*a*, the boom head can be variably fixed at different height positions relative to the mast 5. The longer the bush 25*a*, the larger the available fixing region or the available fixing point for the boom head 33.

As can be seen from FIG. 7*a*, the lateral boom abutment portions 44*a*, 44*b*, in vertical cross section (perpendicularly through the drawing plane according to FIG. 4 or 5), are designed to be appropriately slightly concave between a top and a bottom edge 53, as a result of which the corresponding rail-like boom front arch lateral portions 33*a*, 33*b* can be rotated so as to be effectively guided and abutting in said concave lateral boom abutment portions 44*a*, 44*b*. The central boom abutment portion could also be designed in this way. According to the sectional view in FIG. 7*b*, said portion is recessed only in part with respect to a top and bottom edge 53 and does not have to extend in a strictly concave manner therebetween, but rather can simply be in the form of a recess 52 having a flat base 54.

In the embodiment under discussion, the corresponding clamping jaws 39 can surround the preferably bush-shaped rotary body 25 at the corresponding abutment portions, preferably by means of a slotted sleeve, the large tensioning forces that are produced resulting in the boom front arch and thus the entire boom in the front region being rigidly or largely rigidly fastened to the rotary body 25 by means of said boom-mast holding means 35, which body, in turn, can pivot or rotate about the mast connection portion 5*c*, at least in a sufficiently large angular range. In this case, the mast holder abuts, at least at its leading and in part also at its lateral surface portions, the outer circumference of the preferably bush-shaped rotary or pivoting body 25. At the same time, the tension belt of the boom together with its rear boom end can be brought into the corresponding optimum height at which the end of the sail can be trimmed. This is because it is by all means possible to pivot the boom in the belt 49*a*. The holding means as a whole therefore allows the boom together with the bush-shaped rotary body 25 to pivot in a free or largely free manner about the mast 5, the bush-shaped rotary body 25 itself being held between the bottom mast part 5*a* and the top mast part 5*b* so as to be virtually axially immovable or centred in the longitudinal direction of the mast.

FIG. 5 also shows, by way of derogation from FIG. 4, that the boom-mast holding means 35 does not have to comprise any clamping-jaw- or sleeve-shaped holding or fixing portions 39, but rather the boom-mast holding means 35 can also be slot-free and can thus be closed with the formation of a corresponding receiving opening 37 for said preferably sleeve-shaped rotary body 25, which is then in turn arranged so as to be able to rotate on the mast.

According to the variant under discussion, the mast holder 15 together with its jaw-, sleeve-shaped or bush-shaped portions sits directly on the rotary body 25, preferably said bush 25*a*, and thus surrounds the rotary body 25. In this case, the rotary body 25 is provided with an inner diameter with respect to the receiving hole penetrating the rotary body 25 that, as stated above, is at least slightly larger than the outer diameter of the mast 5 in said fastening region (mast connection portion 5*c*), such that, when there is rigid fixing between the boom and the boom-mast holding means 35, the boom together with the associated boom-mast holding means 35 and the bush 37, which is also fixed with respect to the boom-mast holding means 35, can then freely rotate on the corresponding portion of the mast, which offers a range of advantages in respect of the orientation of the sail with respect to the rig.

As stated above, the boom-mast holding means 34 is preferably a component that is separate with respect to the bush-, sleeve- or clamping-jaw-shaped rotary body 25. This makes it possible to be able to attach a wide range of boom-mast fastening means to said rotary body 25. It is therefore noted at this juncture that said rotary body 25 may be an inherent part of the boom-mast holding means 35, thus part of the rotary body 25. In this case, said holding or fixing portions 39 (which ultimately define the mast-receiving opening 37 or the mast-receiving channel formed thereby) would be placed directly on the outer circumference of the mast portion 5*c* (thus before the bottom mast part 5*a* and the top mast part 5*b* are joined to form a single entity, for example) in order to absorb corresponding tilting moments with respect to the mast 5. The length of the mast-receiving channel 37 and thus the axial length of the holding or fixing portions 39 will in this case preferably have a larger degree of longitudinal extension than is indicated by FIG. 1 or as results for an embodiment explained in the following with reference to FIG. 8.

Generally, this longitudinal extension of the bush-, sleeve- or clamping-jaw-like holding or fixing portion 39 and the rotary body 25 formed thereby can be completely different. The axial measurement (longitudinal measurement) by which the boom-mast holding means 35 can be placed directly on the fastening portion 105 of the mast 5, or is placed by interposition of a separate, preferably bush-shaped rotary body 25, can for example be greater than at least 2 cm, in particular greater than 3 cm, 4 cm, 5 cm, 6 cm, 7 cm, 8 cm, 9 cm, 10 cm, 11 cm, 12 cm, 13 cm, 14 cm and 15 cm. Similarly, it is usually sufficient for this longitudinal measurement to be less than 30 cm, in particular less than 23 cm, 22 cm, 21 cm, 20 cm, 19 cm, 18 cm, 17 cm, 16 cm, 15 cm, 14 cm, 13 cm, 12 cm, 11 cm, 10 cm, 9 cm, 8 cm, 7 cm, 6 cm and 5 cm.

In the variant described in the following according to FIG. 8, instead of the bush shown in FIGS. 4 and 5, a threaded bush 25*b* is used that also runs straight and sits on a straight-running portion of the mast 5 (in particular on the boom-head fastening portion 105, which, in the embodiment shown, is formed by the connection portion 5*c*). Said threaded bush 25*b* also has an inner diameter that is at least slightly larger than the outer diameter of the mast 5 in this region, such that the threaded bush can be rotated about its own longitudinal axis (i.e. the centre axis 5*a*) with as little difficulty as possible.

In this embodiment, the boom-mast holding means 35 itself comprises a mast-holding portion comprising a mast-receiving opening 37 which is designed, for example, as a slotted, but preferably non-slotted (thus closed) hollow-cylindrical boom-mast holding means 35, in particular comprising a corresponding internal thread 35*c*. The design of this embodiment is otherwise in principle the same as the embodiments described above. In other words, the boom-mast holding means 35 can otherwise in principle be designed as in FIGS. 4 and 5.

This design, now using a threaded bush 35 that interacts with a corresponding internal thread in the receiving hole 37 in the boom-mast holding means 35, offers the possibility of the surfer being able to adjust the height position of the boom-mast fastening 35, as needed, by rotating the threaded bush 25*b* positioned on the mast about its own longitudinal axis in the case of a non-rotating boom-mast holding means 35. This also allows for optimisation of the overall orientation and trimming of the sail between the mast and the boom and for a preferred height adjustment of the boom to be performed, by the simplest means possible.

Optionally, a snap-fit final lock may also be provided, as a result of which the threaded bush 137 cannot rotate automatically or inadvertently while surfing, resulting in an inadvertent height adjustment.

The dimensions of the longitudinal extension of the threaded bush and/or of the sleeve- and clamping-jaw-like portion, or of the portion provided with a corresponding internally threaded hole, of the boom-mast holding means 35 can be similar to the embodiment above, which was also explained, inter alia, with reference to FIGS. 4 and 5.

Finally, it is noted that, in order to increase the absorption forces, the boom-mast holding means 35 can also be designed to have two opposing ribs 53, in particular plastics ribs 53, which extend between the jaw-, sleeve- or bush-shaped holding portions 39 to the relevant adjacent boom abutment portions 44*a* or 44*b*.

The invention claimed is:

1. Mast for a rig for a surfboard, comprising the following features:

comprising a mast, the mast is provided, in a longitudinal direction thereof, with a profile cross section that is transverse to the mast longitudinal direction and differs from a circular shape, the profile cross section is drop-shaped or drop-like in the form of a drop profile, a groove, provided with an undercut, is provided on the mast at a tapering end of the drop profile in order to receive a luff of a sail, the mast, in the longitudinal direction thereof, is divided into at least three parts, specifically into a bottom mast part, into a top mast part and into a boom-head fastening portion formed between the bottom mast part and the top mast part, the boom-head fastening portion is provided with a cross section that differs from the drop profile, the cross section in the boom-head fastening portion is configured such that a rotary body placed on the boom-head fastening portion of the mast via a hole in said body can be rotated or pivoted about the boom-head fastening portion, and the bottom mast part and the top mast part of the mast consist of plastics material or include plastics material, optionally with an addition of a reinforcement consisting of metal, glass fibres and/or carbon fibres.

2. Mast according to claim 1, wherein the boom-head fastening portion also consists of plastics material or includes plastics material, optionally with an addition of a reinforcement consisting of metal, glass fibres and/or carbon fibres.

3. Mast according to claim 1, wherein the boom-head fastening portion is axially symmetrical, and in particular rotationally symmetrical with respect to an longitudinal extension thereof.

4. Mast according to claim 1, wherein the boom-head fastening portion is configured as a mast connection portion that interconnects the bottom mast part and the top mast part.

5. Mast according to claim 1, wherein a length of the fastening portion is greater than 2 cm and/or a length of the fastening portion is shorter than 20 cm.

6. Mast according to claim 1, wherein the boom-head fastening portion is configured as a mast connection portion, via which the bottom mast part and the top mast part are or can be interconnected in the form of a plug-in connection.

7. Mast according to claim 1, wherein the mast can be dismantled at least into two parts, specifically into the bottom mast part and into the top mast part, the boom-head fastening portion being rigidly connected to the bottom mast part or to the top mast part, and it therefore being possible for a free end of the boom-head fastening portion to be inserted into a receiving hole in the end face of the top mast part or in an end face of the bottom mast part.

8. Mast according to claim 1, wherein the mast can be dismantled into at least three parts, specifically into a bottom mast part, into a top mast part and into a mast connection portion, the bottom mast part, the top mast part and the boom-head fastening portion located therebetween being detachably interconnected in the form of a plug-in and/or rotary connection.

9. Mast according to claim 1, wherein the mast has a cross-sectional area that changes, at least in part, over a total length thereof, decreasing towards the mast top.

10. Mast according to claim 1, wherein the mast is curved or runs straight when untrimmed.

11. Mast according to claim 1, wherein a rotary body is or can be placed on the boom-head fastening portion and can be rotated or pivoted, at least completely freely or in a predefined angular range, about the boom-head fastening portion.

12. Mast according to claim 11, wherein the rotary body consists of a bush or includes a bush.

13. Mast according to claim 12, wherein the rotary body, in particular in the form of a bush, has a length in the longitudinal direction of the mast and in particular of the boom-head fastening portion, that corresponds to or is marginally smaller than a free space between an end face at the top of the bottom mast part and an end face at the bottom of the top mast part.

14. Mast according to claim 1, wherein the rotary body has zero clearance or approximately zero clearance in an axial direction of the mast and in particular in an axial direction of a mast connection portion, and is therefore axially immovable.

15. Mast according to claim 1, wherein a boom-mast fastener is further provided for fixing a boom front arch or boom head to the mast, which boom-mast fastener includes a bush-shaped rotary body as part of a mast holder or can be placed on or is fastened to a rotary body.

16. Rig for a surfboard comprising a sail, a boom and a mast according to claim 1.

17. Rig according to claim 16, wherein a boom-mast holder and/or the rotary body in the form of a bush is detachably anchorable to the mast and in particular to a mast connection portion and forms a boom-head fastening portion.

18. Rig according to claim 16, wherein, the boom-mast fastener includes a holding body, the holding body comprises a mast-receiving channel, the holding body further includes a boom-head abutment portion which is positioned in a leading direction and extends transversely or perpendicularly to a central longitudinal axis of the mast-receiving channel, the boom-head abutment portion on the holding body is configured so as to be offset from the mast-receiving channel in the leading direction, and a boom-head holder is provided which is part of the holding body or is fastened thereto and/or supported thereon.

19. Rig according to claim 18, wherein the mast-receiving channel is closed and is thus bush-shaped or sleeve- or clamping-jaw-shaped having a slot extending on a trailing side of the mast-receiving channel in parallel with the longitudinal direction of said channel.

20. Rig according to claim 18, wherein the holding body includes a central boom abutment portion which is abutted on each opposing side by a boom front arch lateral portion, the two boom front arch lateral portions extending so as to significantly diverge from one another.

21. Rig according to claim 18, wherein a boom head is positioned in its position fixed to the holding body in such a way that a boom front arch central portion is raised by a central boom abutment portion of the holding body such that two boom front arch lateral portions which abut the boom front arch central portion are supported on two boom abutment portions which abut the central boom abutment portion of the holding body on each opposing side, which central boom abutment portion is provided centrally for this purpose.

22. Rig according to claim 18, wherein the mast-receiving channel is part of the holding body or in that a bush is provided in the mast-receiving channel, which bush, when the mast is assembled, is penetrated in particular by a boom-head fastening portion located on the mast, which portion is formed between a bottom mast part and a top mast part provided as an extension of said bottom mast part.

23. Rig according to claim 18, wherein, when the boom is mounted, the holding body of the boom-mast fastener is fixed to a bush such that the boom can be pivoted together with the bush about a mast connection portion.

24. Rig according to claim 16, wherein a boom head is held so as to be rotatable about a pivot axis (X) extending transversely to an axial extension of a mast-receiving channel.

25. Rig according to claim 16, wherein a boom-head holder includes a tension element, in the form of a belt, via which a boom head is held on a holding body.

26. Rig according to claim 25, wherein the tension element is non-resilient but flexible, in particular deformable or bendable.

27. Rig according to either claim 25, wherein the tension element consists of a circumferentially closed tension element which extends, in two superimposed planes, in two parallel loops on a rear side around sleeve-, clamping-jaw- or bush-shaped mast-receiving-channel walls and, from there, around the boom head in two laterally offset planes on a boom head.

28. Rig according to claim 16, wherein a boom front arch lateral portion can be fastened at various height positions, i.e. at various points in the longitudinal direction of a bush-shaped rotary body, and can thus be fastened at various height positions with respect to the mast.

29. Rig according to claim 28, wherein the bush is a threaded bush, a mast-receiving channel having an internal thread such that the threaded bush is rotatably arranged, via an external thread thereof, in the internal thread, as a result of which a height position of a fastening point of the boom can be altered and/or can be variably adjusted with respect to the mast.

30. Rig according to claim 16, wherein a fastening point of the boom head is adjustable in the longitudinal direction with respect to the mast.

* * * * *